US008321095B2

(12) United States Patent
Kawasaki et al.

(10) Patent No.: US 8,321,095 B2
(45) Date of Patent: Nov. 27, 2012

(54) CONTROL DEVICE FOR HYBRID CONSTRUCTION MACHINE

(75) Inventors: Haruhiko Kawasaki, Toyko (JP); Masahiro Egawa, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 267 days.

(21) Appl. No.: 12/988,651

(22) PCT Filed: Apr. 20, 2009

(86) PCT No.: PCT/JP2009/057829

§ 371 (c)(1),
(2), (4) Date: Oct. 20, 2010

(87) PCT Pub. No.: WO2009/131085

PCT Pub. Date: Oct. 29, 2009

(65) Prior Publication Data

US 2011/0035102 A1 Feb. 10, 2011

(30) Foreign Application Priority Data

Apr. 25, 2008 (JP) ..... 2008-115956

(51) Int. Cl.
*G06G 7/50* (2006.01)
*B60K 17/00* (2006.01)

(52) U.S. Cl. ..... 701/50; 701/36

(58) Field of Classification Search ..... 701/50, 701/36

See application file for complete search history.

(56) References Cited

U.S. PATENT DOCUMENTS 6,708,787 B2 * 3/2004 Naruse et al. ..... 180/53.8
6,725,581 B2 * 4/2004 Naruse et al. ..... 37/348
7,565,801 B2 * 7/2009 Tozawa et al. ..... 60/414

FOREIGN PATENT DOCUMENTS

JP 2003049810 2/2003
JP 2003329012 11/2003
JP 2007010006 1/2007
JP 2007327527 12/2007

OTHER PUBLICATIONS

Internal Search Report for International Application No. PCT/JP2009/057829 dated Jul. 28, 2009, 3 pages.

* cited by examiner

*Primary Examiner* — Khoi Tran
*Assistant Examiner* — Ryan Rink
(74) *Attorney, Agent, or Firm* — Cozen O'Connor

(57) ABSTRACT

The amount of assist for a sub-pump (SP) is reduced when a rotating motor (RM) is singly operated, and the amount of assist for the sub-pump (SP) is increased except when the rotating motor (RM) is singly operated. A controller (C) has a function which, when a signal representing single operation of a rotating motor is inputted in the controller from a single operation detecting means and, at the same time, when a single indicating that assist is required is inputted from an assist controlling input means (A1) in the controller, controls either or both of the speed of an electric motor (MG) and the tilt angle of the sub-pump (SP) based on a low-output set value lower than a value for normal operation of the rotating motor, which is operation other than when the rotating motor is singly operated.

4 Claims, 3 Drawing Sheets

CONTROL DEVICE FOR HYBRID CONSTRUCTION MACHINE

BACKGROUND OF THE INVENTION

1. Field of the Invention

This invention relates to a control device for a hybrid construction machine such as, for example, a power shovel.

2. Description of the Related Art

Various types of devices for combining the discharge flow of the main pump and the discharge flow of the sub-pump to assist the output of the pump to be delivered to an actuator have been long known.

Most of such devices are configured to provide an approximately equal assist force to each of the actuators connected to the circuit.

However, when a rotating motor alone is operated, the assist force provided by the sub-pump is not much required. For example, during the acceleration of the rotating motor, a pressure is required, but a flow rate is not much required. Whereas, upon entry into the steady rotating state after the completion of acceleration, the pressure is not much required, but the flow rate is mainly required in order to maintain the speed.

In either case, the related-art control devices for construction machines controls the assist from the sub-pump in the single operation of the rotating motor which does not much require the assist from the sub-pump, as well as in other regular working operations than the single operation of the rotating motor.

[Patent Literature 1] JP-A 2002-275945

SUMMARY OF THE INVENTION

Related-art devices as described above have a disadvantageous problem of an increased amount of energy consumed more than necessary because the sub-pump is operated to provide assist in the single operation of the rotating motor which does not much require the assist from the sub-pump, as well as in regular working operations except the single operation of the rotating motor.

An increase in the amount of energy consumed means an increase in the power consumption of a battery in, for example, a device including the above-described sub-pump driven by an electric motor, leading to a necessity to increase the number of times the battery must be charged.

The assist, which is provided from the sub-pump in the single operation of the rotating motor as done in the regular working operations except the single operation of the rotating motor, is often delivered excessively, resulting in a rotation of the rotating motor at a higher speed than necessary. However, when the construction machine is, for example, a power shovel, upon the rotation of the rotating motor, the vehicle body together with a boom and/or the like rotates concurrently with this rotation. If, at this moment, the rotating motor rotates at a higher speed than necessary, the rotating motor has great inertial energy, a hard brake application is impossible and also it is difficult to stop the rotation in a predetermined position. For this reason, if the rotating motor rotates at a higher speed than necessary, the time until an emergency brake becomes effective is longer, resulting in dangers that persons around the machine are hit or articles around the machine are broken.

It is an object of the present invention to provide a control device for a hybrid construction machine that provides a different assist force to a rotating motor in the single operation of a rotating motor from in regular working operations except the single operation of the rotating motor.

A first invention provides a control device for a hybrid construction machine which includes a variable displacement type of a main pump a circuit system connected to the main pump and including a plurality of operated valves for controlling actuators, and an operated valve for controlling a rotating motor provided in the circuit system. The control device comprises a single operation detection unit that detects single operation of the rotating motor; a variable displacement type of a sub-pump; a tilt angle control unit controlling a tilt angle of the sub-pump; an electric motor that is a driving source of the sub-pump; a merging passage connected to the sub-pump and communicating with a discharge side of the main pump; an assist control input unit that inputs a signal representing whether or not assist control is required in the single operation of the rotating motor; and a controller that controls the tilt angle of the sub-pump and a rotational speed of the electric motor.

the controller comprising a function of controlling one of or both a rotational speed of the electric motor and a tilt angle of the sub-pump on the basis of a low output set value which is relatively lower than a low output set value in regular working operations except the single operation of the rotating motor, when the controller receives the signal representing a rotating-motor single operation from the single operation detection unit and receives the signal representing a need for an assist from the assist control input unit.

A second invention provides the controller that stores normal control characteristics of regulating output of the sub-pump to a high-output set value in regular working operations except the single operation of the rotating motor, and rotation single control characteristics of regulating output of the sub-pump to a low-output set value when an assist is required in the single operation of the rotating motor. The controller comprises a function of controlling the output of the sub-pump on the basis of the normal control characteristics in the regular working operations and controlling the output of the sub-pump on the basis of the rotation single control characteristics when controlling the single operation of the rotating motor and when an assist is required.

A third and a fourth invention provides the controller that comprises a function of setting output of the sub-pump to zero when an assist is not required in the single operation of the rotating motor.

According to the first invention, since the amount of assist of the sub-pump is controlled to become relatively lower in the single operation of the rotating motor than that in the regular working operations except the single operation of the rotating motor, the amount of energy consumed, such as battery power, can be reduced. In addition, the rotating motor does not rotate at a higher speed than necessary in the single operation of the rotating motor, resulting in improved safety.

According to the second invention, the assist force of the sub-pump can be controlled individually for the previously-stored normal control characteristics and for the previously-stored rotation single control characteristics. This makes it possible to implement uniform control in each control of the normal control and the rotation single control, resulting in a simplified control system.

According to the third and the fourth invention, when the assist is not required in the single operation of the rotating motor, the assist flow rate can be set to zero, thus minimizing the energy loss.

DETAILED DESCRIPTION OF THE INVENTION

FIG. 1 illustrates a device for controlling a power shovel according to an exemplary embodiment of the present invention, which includes a variable displacement type of a first and a second main pump MP1, MP2. The first main pump MP1 is connected to a first circuit system, while the second main pump MP2 is connected to a second circuit system.

To the first circuit system are connected, in order of upstream toward downstream, a rotating-motor operated valve 1 for controlling a rotating motor RM, an arm-in-first-gear operated valve 2 for controlling an arm cylinder (not shown), a boom-in-second-gear operated valve 3 for controlling a boom cylinder BC, an auxiliary operated valve 4 for controlling an auxiliary attachment (not shown), and a first travel-motor operated valve 5 for controlling a first travel motor intended for left traveling (not shown).

Each of the operated valves 1 to 5 is connected to the first main pump MP1 via a neutral flow passage 6 and a parallel passage 7.

A pilot pressure generating mechanism 8 is disposed on the neutral flow passage 6 downstream from the first travel-motor operated valve 5. The pilot pressure generating mechanism 8 generates a higher pilot pressure with a higher rate of flow passing through the mechanism 8, and a lower pilot pressure with a lower rate of flow.

When all the operated valves 1 to 5 are in or near the neutral position, the neutral flow passage 6 guides all or part of the fluid discharged from the first main pump MP1 to a tank T. At this condition, the rate of flow passing through the pilot-pressure generating mechanism 8 is increased, so that a high pilot pressure is generated as described above.

On the other hand, when switching the operated valves 1 to 5 in a full stroke position, the neutral flow passage 6 is closed to block the flow of fluid. In this case, accordingly, the rate of flow passing through the pilot-pressure generating mechanism 8 is almost zero, which means that a pilot pressure of zero is kept.

However, depending on manipulated variables of the operated valves 1 to 5, a portion of the pump discharge flow is directed to an actuator and another portion is directed from the neutral flow passage 6 to the tank T. As a result, the pilot pressure generating mechanism 8 generates a pilot pressure in accordance with the rate of flow passing through the neutral flow passage 6. In other words, the pilot pressure generating mechanism 8 generates a pilot pressure in accordance with the manipulated variables of the operated valves 1 to 5.

A pilot flow passage 9 is connected to the pilot-pressure generating mechanism 8, and also connected to a regulator 10 for controlling the tilt angle of the first main pump MP1. The regulator 10 controls the discharge rate of the first main pump MP1 in inverse proportion to the pilot pressure. Accordingly, when the operated valves 1 to 5 are fully stroked and then the flow rate in the neutral flow passage 6 changes to zero, in other words, when the pilot pressure generated by the pilot-pressure generating mechanism 8 reaches zero, the discharge rate of the first main pump MP1 is maintained at maximum.

A first pressure sensor 11 is connected to the pilot flow passage 9 configured as described above, and detects a pressure signal which is then applied to a controller C. The pilot pressure in the pilot flow passage 9 varies in accordance with the manipulated variable of the operated valve. As a result, the pressure signal detected by the first pressure sensor 11 is proportional to the flowrate required by the first circuit system.

In turn, to the second circuit system are connected, in order of upstream toward downstream, a second travel-motor operated valve 12 for controlling a second travel motor intended for right traveling (not shown), a bucket operated valve 13 for controlling a bucket cylinder (not shown), a boom-in-first-gear operated valve 14 for controlling the boom cylinder BC, and an arm-in-second-gear operated valve 15 for controlling the arm cylinder (not shown).

Each of the operated valves 12 to 15 is connected to the second main pump MP2 through the neutral flow passage 16. The bucket operated valve 13 and the boom-in-first-gear operated valve 14 are connected to the second main pump MP2 through a parallel passage 17.

A pilot-pressure generating mechanism 18 is provided on the neutral flow passage 16 downstream from the arm-in-second-gear operated valve 15. The pilot-pressure generating mechanism 18 is exactly identical in function with the pilot-pressure generating mechanism 8 described earlier.

A pilot flow passage 19 is connected to the pilot-pressure generating mechanism 18, and also connected to a regulator 20 for controlling the tilt angle of the second main pump MP2. The regulator 20 controls the discharge rate of the second main pump MP2 in inverse proportion to the pilot pressure. Accordingly, when the operated valves 12 to 15 are fully stroked and the flow rate in the neutral flow passage 16 changes to zero, in other words, when the pilot pressure generated by the pilot-pressure generating mechanism 18 reaches zero, a maximum discharge rate of the second main pump MP2 is maintained.

A second pressure sensor 21 is connected to the pilot flow passage 19 configured as described above, and detects a pressure signal which is then applied to the controller C. The pilot pressure in the pilot flow passage 19 varies in accordance with the manipulated variable of the operated valve. As a result, the pressure signal detected by the second pressure sensor 21 is proportional to the flowrate required by the second circuit system.

The first, second main pumps MP1, MP2 arranged as described above rotate coaxially by a drive force of one engine E. The engine E is equipped with a generator 22, such that the generator 22 is rotated by an excess output of the engine E for electric generation. The electric power generated by the generator 22 passes through a battery charger 23 to recharge the battery 24.

The battery charger 23 is adapted to recharge the battery 24 even when it is connected to a general household power source 25. That is, the battery charger 23 is connectable to an independent power source other than the controller.

An actuator port of the rotating-motor operated valve 1 connected to the first circuit system is connected to passages 26, 27 which communicate with the rotating motor RM. Brake valves 28, 29 are respectively connected to the passages 26, 27. When the rotating-motor operated valve 1 is kept in its neutral position (not shown), the actuator port is closed, so that the rotating motor RM maintains its stop state.

The rotating-motor operated valve 1 is switched from this position to, for example, a right position in FIG. 1, whereupon one passage 26 of the passages 26, 27 is connected to the first main pump MP1, while the other passage 27 is connected to the tank T. As a result, a pressure fluid is supplied through the passage 26 to rotate the rotating motor RM, while the return fluid flows from the rotating motor RM through the passage 27 back to the tank T.

On the other hand, when the rotating-motor operated valve 1 is switched to a left position, the pump discharge fluid flows into the passage 27, while the passage 26 is connected to the tank T, so that the rotating motor RM rotates in the opposite direction.

In this manner, during the operation of the rotating motor RM, the brake valve 28 or 29 functions as a relief valve. Then, when the pressure in the passage 26, 27 exceeds a set pressure, the brake valve 28, 29 is opened to introduce the fluid from the high pressure side to the low pressure side. When the rotating-motor operated valve 1 is moved back to the neutral position while the rotating motor RM is rotating, the actuator port of the operated valve 1 is closed. Even when the actuator port of the operated valve 1 is closed in this manner, the rotating motor RM continues to rotate by its inertial energy. By rotating by its inertial energy, the rotating motor RM acts as a pump. At this stage, the passages 26, 27, the rotating motor RM and the brake valve 28 or 29 form a closed circuit. The brake valve 28 or 29 converts the inertial energy to thermal energy.

On the other hand, when the boom-in-first-gear operated valve 14 is switched from the neutral position to a right position in FIG. 1, the pressure fluid flowing from the second main pump MP2 is supplied through a passage 30 to a piston chamber 31 of the boom cylinder BC, and the return fluid flows from a rod chamber 32 of the boom cylinder BC through a passage 33 to the tank T, resulting in extension of the boom cylinder BC.

In contrary, upon switching of the boom-in-first-gear operated valve 14 in the left direction in FIG. 1, a pressure fluid flowing from the second main pump MP2 is supplied through the passage 33 to the rod chamber 32 of the boom cylinder BC, while the return fluid flows from the piston chamber 31 through the passage 30 back to the tank T, resulting in contraction of the boom cylinder BC. Note that the boom-in-second-gear operated valve 3 is switched in conjunction with the boom-in-first-gear operated valve 14.

A proportional solenoid valve 34, the degree of opening of which is controlled by the controller C, is provided on the passage 30 connected between the piston chamber 31 of the boom cylinder BC and the boom-in-first-gear operated valve 14 as described above. Note that the proportional solenoid valve 34 is kept in the full open position when it is in its normal state.

Next, a variable displacement sub-pump SP for assisting in the output of the first, second main pump MP1, MP2 will be described.

The variable displacement sub-pump SP rotates by a drive force of an electric motor MG also serving as a generator, and a variable displacement assist motor AM also rotates coaxially by the drive force of the electric motor MG. The electric motor MG is connected to an inverter I. The inverter I is connected to the controller C. Thus, the controller C can control a rotational speed and the like of the electric motor MG.

Tilt angles of the sub-pump SP and the assist motor AM are controlled by tilt-angle control units 35, 36 which are controlled through output signals of the controller C.

The sub-pump SP is connected to a discharge passage 37. The discharge passage 37 is divided into two passages, a first merging passage 38 that merges with the discharge side of the first main pump MP1 and a second merging passage 39 that merges with the discharge side of the second main pump MP2. The first, second merging passages 38, 39 are respectively provided with first, second proportional solenoid throttling valves 40, 41 the degrees of openings of which are controlled by signals output from the controller C.

On the other hand, the assist motor AM is connected to a connection passage 42. The connection passage 42 is connected through the merging passage 43 and check valves 44, 45 to the passages 26, 27 which are connected to the rotating motor RM. In addition, a solenoid directional control valve 46, the opening/closing of which is controlled by the controller C, is provided on the merging passage 43. A pressure sensor 47 is disposed between the solenoid directional control valve 46 and the check valves 44, 45 for detecting a pressure of the rotating motor RM in the rotating operation or a pressure of it in the braking operation. A pressure signal of the pressure sensor 47 is applied to the controller C.

A pressure relief valve 48 is provided on the merging passage 43 downstream from the solenoid directional control valve 46 for the flow from the rotating motor RM to the connection passage 42. The pressure relief valve 48 maintains the pressure in the passages 26, 27 to prevent so called runaway of the rotating motor RM in the event of a failure occurring in the system of the passages 42, 43, for example, in the solenoid directional control valve 46 or the like.

Another passage 49 is provided between the boom cylinder BC and the proportional solenoid valve 34 and communicates with the connection passage 42. A solenoid on/off valve 50 controlled by the controller C is disposed on the passage 49.

The controller C is also connected to assist setting input means AI. The operator determines whether to turn on or off the assist set input means AI in the single operation of the rotating motor RM. When determining to require an assist, the operator turns on the assist setting input means AI.

The controller C stores normal control characteristics of controlling the assist force of the sub-pump SP in the regular working operation, and rotation single control characteristics of controlling the assist force of the sub-pump SP in the single operation of the rotating motor, as shown in FIG. 2. The regular working operation means working conditions except when the rotating motor RM is singly operated.

As is clear from FIG. 2, the assist force is relatively larger in the normal control characteristics than in the rotation single control characteristics.

If the operated valves 1 to 5 in the first circuit system are kept in their neutral positions, the total amount of fluid discharged from the first main pump MP1 is introduced through the neutral passage 6 and the pilot pressure generating mechanism 8 to the tank T. When the total amount of fluid discharged from the first main pump MP1 flows through the pilot pressure generating mechanism 8 in this manner, the pilot pressure generating mechanism 8 generates a high pilot pressure, and a relatively high pilot pressure is introduced into the pilot passage 9. Then, the high pilot pressure introduced into the pilot passage 9 acts to operate the regulator 10, so that the regulator 10 maintains the discharge rate of the first main pump MP1 at a minimum. A pressure signal indicative of the high pilot pressure at this stage is applied to the controller C from the first pressure sensor 11.

Similarly, when the operated valves 12 to 15 in the second circuit system are kept in their neutral positions, the pilot pressure generating mechanism 18 generates a relatively high pilot pressure as in the case of the first circuit system, and the high pilot pressure acts on the regulator 20, so that the regulator 20 maintains the discharge rate of the second main pump MP2 at a minimum. A pressure signal indicative of the high pilot pressure at this stage is applied to the controller C from the pressure sensor 21.

Upon reception of the signal indicative of the relatively high pressure from the first, second pressure sensor 11, 21, the controller C determines that the first, second main pump MP1, MP2 maintains a minimum discharge rate and controls the tilt control unit 35, 36 to reduce the tilt angles of the sub-pump SP and the assist motor AM to zero or to a minimum.

Note that the controller C may either stop or continue the rotation of the electric motor MG when the controller C receives a signal indicative of a minimum discharge rate of the first, second main pump MP1, MP2 as described above.

When the rotation of the electric motor MG is stopped, there is an advantageous effect of reduced power consumption. When the rotation of the electric motor MG is continued, the sub-pump SP and the assist motor AM continue to rotate. As a result, there is an advantageous effect of lessened impact occurring when the sub-pump SP and the assist motor AM are started. In either case, whether the electric motor MG should be stopped or continued to rotate may be determined with reference to a use or use environment of the construction machine.

By switching any operated valve in the first circuit system or the second circuit system under the conditions as described above, the rate of flow passing the neutral passage 6 or 16 is reduced in accordance with the manipulated variable, which involves a reduction in the pilot pressure generated by the pilot pressure generating mechanism 8 or 18. As the pilot pressure reduces, the first main pump MP1 or the second main pump MP2 increases its tilt angle to increase its discharge rate.

Accordingly, the flow rate required by the first, second circuit system is determined in accordance with the pilot pressure in the pilot flow passage 9, 19. For example, the higher the pilot pressure, the lower the flow rate required by the circuit system, whereas the lower the pilot pressure, the higher the flow rate required by the circuit system.

In this regard, a sensor (not shown) is provided in each of the operated valves 1 to 5, 12 to 15 for detecting whether or not the operated valve is switched, and is connected to the controller C. The sensor provided in each operated valve forms single operation detecting means for detecting the single operation of the rotating motor. Specifically, when the rotating motor RM is operated singly, the rotating-motor operated valve 1 alone is switched. Therefore, a signal received by the controller C is only the signal from the sensor in the operated valve 1. Thus, the controller C can determine that the rotating motor RM is operated singly when receiving only a signal from the sensor provided in the operated valve 1.

Next, the function of the controller C will be described with reference to the flowchart in FIG. 3.

The controller C reads signals transmitted from the first, second pressure sensors 11, 21 as described above (step S1). Then, the controller C calculates a proportional distribution of the flow rates required by the first, second circuit systems in accordance with the pilot pressure signals (step S2), and determining whether or not the rotating motor RM is operated singly (step S3).

In the normal control in which the rotating motor RM alone is not operated, in other words, in the normal control in which either the rotating motor RM and concurrently any actuator(s) are operated or any actuator(s) other than the rotating motor RM is operated, the controller C sets a power control value (step S4) and a torque control value (step S5), on the basis of the normal condition characteristics that exhibit high-output setting of the assist force shown in FIG. 2.

The controller C also determines flow split values for splitting the flow into two, the first and second circuit systems, on the basis of the proportional distribution calculated at step S2 (step S6).

Then, the controller C maintains the normal control characteristics, and simultaneously calculates the most efficient rotational speed of the electric motor MG and the most efficient tilt angle of the sub-pump SP, and then controls the rotational speed of the electric motor MG and the tilt angle of the sub-pump SP to the calculated rotational speed and the calculated tilt angle (step S7). At this stage, the controller C controls the degrees of opening of the first, second proportional solenoid throttling valves 40, 41 such that the discharge flow of the sub-pump SP can be divided proportionally between and delivered to the first, second circuit systems.

When performing control based on the normal control characteristics as described above, the electric motor MG is rotated beyond the rated capacity. However, if the load on the sub-pump SP becomes greater, the controller C, for example, reduces the tilt angle of the sub-pump SP for control of maintaining the power control value and the torque control value within the range of the high output settings. On the other hand, if the load on the sub-pump SP becomes smaller, the controller C, for example, increases the tilt angle of the sub-pump SP, increases the rotational speed of the electric motor MG, or alternatively controls simultaneously both the tilt angel and the rotational speed, for control of maintaining the power control value and the torque control value on the basis of the aforementioned normal control characteristics.

On the other hand, in the single operation of the rotating motor RM, the process moves from step S3 to step S8, and the controller C determines whether or not the operator has turned on the assist setting input means AI in order to determine whether or not assist control is required.

If the operator does not turn on the assist setting input means AI, the controller C determines that the assist is not required, and goes to step S9 to set "assist zero". In the assist zero setting, the controller C, for example, reduces the tilt angle of the sub-pump SP to zero or the rotational speed of the electric motor MG to zero at step S7.

When the operator turns on the assist setting input means AI, the controller C goes to step S10 to perform control of limiting the rotation power. Specifically, the controller C controls the assist flow rate of the sub-pump SP on the basis of the rotation single control characteristics of the low output setting which is relatively lower than that in the normal control characteristics.

It should be understood that, in this stage, the controller C controls the degrees of opening of the first, second proportional solenoid throttling valves 40, 41 in response to the pressure signals from the first, second pressure sensors 11, 12.

According to the embodiment as described above, in the other operations than the single operation of the rotating motor RM, the assist force of the sub-pump SP can be relatively increased, and in the single operation of the rotating motor RM, the assist force of the sub-pump SP can be relatively decreased. Accordingly, a reduction of the amount of energy consumed, such as battery power, is possible. In addition, the rotating motor does not rotate at a higher speed than necessary in the single operation of the rotating motor, resulting in improved safety.

Since the controller is able to control individually the operation based on the previously-stored normal control characteristics and the operation based on the previously-stored rotation single control characteristics, uniform control can be implemented in each of the normal control and the rotation single control, resulting in a simplified control system. Further, when the assist is not required during the single operation of the rotating motor, the assist flow rate can be set to zero, thus minimizing the energy loss.

Next, a description will be given of a typical operation of actuators of the work mechanical system.

For driving the rotating motor RM connected to the first circuit system, the rotating-motor operated valve 1 is switched to either right or left position. For example, switching of the operated valve 1 to the right position in FIG. 1 causes one passage 26 of the passages 26, 27 to communicate with the first main pump MP1 and the other passage 27 to communicate with the tank T in order to rotate the rotating motor RM. The rotation pressure at this time is maintained at a set pressure of the brake valve 28. On the other hand, when the operated valve 1 is switched to the left position in FIG. 1, the passage 27 communicates with the first main pump MP1 while the passage 26 communicates with the tank T in order to rotate the rotating motor RM. The rotation pressure at this time is maintained at a set pressure of the brake valve 29.

When the rotating-motor operated valve 1 is switched to the neutral position during the rotation of the rotating motor RM, a closed circuit is constituted between the passages 26, 27 as described earlier, and the brake valve 28 or 29 keeps the brake pressure in the closed circuit for conversion of inertial energy to thermal energy.

The pressure sensor 47 detects a rotation pressure or a brake pressure and applies a signal indicative of the detected pressure to the controller C. When the detected pressure is lower than the set pressure of brake valve 28, 29 within a range of it having no influence on the rotation of the rotating motor RM or the braking operation, the controller C switches the solenoid directional control valve 46 from the closed position to the open position. By thus switching the solenoid directional control valve 46 to the open position, the pressure fluid introduced into the rotating motor RM flows into the merging passage 43 and then through the pressure relief valve 48 and the connection passage 42 into the assist motor AM.

At this stage, the controller C controls the tilt angle of the assist motor AM in response to the pressure signal from the pressure sensor 47 as follows.

Specifically, if the pressure in the passage 26 or 27 is not maintained at a level required for the rotating operation or the braking operation, the rotating motor RM cannot be rotated or the brakes cannot be applied.

Therefore, in order to maintain the pressure in the passage 26 or 27 to be equal to the rotation pressure or the brake pressure, the controller C controls the load on the rotating motor RM while controlling the tilt angle of the assist motor AM. Specifically, the controller C controls the tilt angle of the assist motor AM such that the pressure detected by the pressure sensor 47 becomes approximately equal to the rotation pressure of the rotating motor RM or the brake pressure.

If the assist motor AM obtains a torque as described above, then the torque acts on the electric motor MG which rotates coaxially with the assist motor AM, which means that the torque of the assist motor AM acts as an assist force intended to the electric motor MG. This makes it possible to reduce the power consumption of the electric motor MG by an amount of power corresponding to the torque of the assist motor AM.

The torque of the assist motor AM may be used to assist the torque of the sub-pump SP. In this event, the assist motor AM and the sub-pump SP are combined with each other to exercise the pressure conversion function.

That is, the pressure of the fluid flowing into the connection passage 42 is inevitably lower than the pump discharge pressure. For the purpose of using the low pressure to maintain a high discharge pressure of the sub-pump SP, the assist motor AM and the sub-pump SP are adapted to fulfill the booster function.

Specifically, the output of the assist motor AM depends on a product of a displacement volume Q1 per rotation and the pressure P1 at this time. Likewise, the output of the sub-pump SP depends on a product of a displacement volume Q2 per rotation and the discharge pressure P2. In the embodiment, since the assist motor AM and the sub-pump SP rotate coaxially, equation Q1XP1=Q2XP2 must be established. For this purpose, for example, assuming that the displacement volume Q1 of the assist motor AM is three times as high as the displacement volume Q2 of the sub-pump SP, that is, Q1=3Q2, the equation Q1XP1=Q2XP2 results in 3Q2XP1=Q2XP2. Dividing both sides of this equation by Q2 gives 3P1=P2.

Accordingly, if the tilt angle of the sub-pump SP is changed to control the displacement volume Q2, a predetermined discharge pressure of the sub-pump SP can be maintained using the output of the assist motor AM. In other words, the pressure of the fluid from the rotating motor RM can be built up and then the fluid can be discharged from the sub-pump SP.

In this regard, the tilt angle of the assist motor AM is controlled such that the pressure in the passage 26, 27 is maintained to be equal to the turning pressure or the brake pressure. For this reason, in the case of using the fluid flowing from the rotating motor RM, the tilt angle of the assist motor AM is logically determined. After the tilt angle of the assist motor AM has been determined in this manner, the tilt angle of the sub-pump SP is controlled in order to fulfill the pressure conversion function.

If the pressure in the system including the connection passages 42, 43 is reduced below the turning pressure or the brake pressure for any reasons, the controller C closes the solenoid directional control valve 46 on the basis of the pressure signal sent from the pressure sensor 47 such that the rotating motor RM is not affected.

When a fluid leak occurs in the connection passage 42, the pressure relief valve 48 operates to prevent the pressure in the passage 26, 27 to reduce more than necessary, thus preventing runaway of the rotating motor RM.

Next, a description will be given of control for the boom cylinder by switching the boom-in-first-gear operated valve 14 and the boom-in-second-gear operated valve 3 in the first circuit system working in conjunction with the operated valve 14.

The boom-in-first-gear operated valve 14 and the operated valve 3 working in conjunction with it are switched in order to actuate the boom cylinder BC, whereupon the sensor detects the manipulated direction and the manipulated variable of the operated valve 14, and sends the manipulation signal to the controller C.

The controller C determines in response to the manipulation signal of the sensor whether the operator is about to move up or down the boom cylinder BC. If the controller C receives a signal indicative of moving-up of the boom cylinder BC, the controller C maintains the proportional solenoid valve 34 in a normal state. In other words, the proportional solenoid valve 34 is kept in its full-open position. At this time, the controller C keeps the solenoid on/off valve 50 in the closed position shown in FIG. 1 and controls the rotational speed of the electric motor MG and the tilt angle of the sub-pump SP in order to ensure a predetermined discharge rate of the sub-pump SP.

On the other hand, upon the reception of the signal indicative of moving-down of the boom cylinder BC from the sensor, the controller C calculates a moving-down speed of the boom cylinder BC desired by the operator in accordance with the manipulated variable of the boom-in-first-gear operated valve 14, and closes the proportional solenoid valve 34 and switches the solenoid on/off valve 50 to the open position.

By closing the proportional solenoid valve 34 and switching the solenoid on/off valve 50 to the open position as described above, the total amount of return fluid from the boom cylinder BC is supplied to the assist motor AM. However, if the flow rate consumed by the assist motor AM is lower than the flow rate required for maintaining the moving-down speed desired by the operator, the boom cylinder BC cannot maintains the moving-down speed desired by the operator. In this event, the controller C controls, based on the manipulated variable of the operated valve 14, the tilt angle of the assist motor AM, the rotational speed of the electric motor MG and the like, the degree of opening of the proportional solenoid valve 34 to direct a greater flow rate than that consumed by the assist motor AM back to the tank T, thus maintaining the moving-down speed of the boom cylinder BC desired by the operator.

On the other hand, upon the fluid flowing into the assist motor AM, the assist motor AM rotates and this torque acts on the electric motor MG which rotates coaxially. In turn, the torque of the assist motor AM acts as an assist force intended to the electric motor MG. Thus, the power consumption can be reduced by an amount of power corresponding to the torque of the assist motor AM.

In this regard, the sub-pump SP can be rotated using only a torque of the assist motor AM without a power supply to the electric motor MG. In this case, the assist motor AM and the sub-pump SP exercise the pressure conversion function as in the aforementioned case.

Next, the simultaneous actuation of the rotating motor RM for the rotation operation and the boom cylinder BC for the moving-down operation will be described.

When the boom cylinder BC is moved down while the rotating motor RM is operated for the turning operation, the fluid from the rotating motor RM and the return fluid from the boom cylinder BC join in the connection passage 42 and flow into the assist motor AM.

In this regard, if the pressure in the connection passage 42 rises, the pressure in the merging passage 43 also rises with this pressure rise. Even if the pressure in the merging passage 43 exceeds the turning pressure or the brake pressure of the rotating motor RM, it has no influence on the rotating motor RM because the check valves 44, 45 are provided.

If the pressure in the connection passage 42 reduces lower than the turning pressure or the brake pressure, the controller C closes the solenoid directional control valve 46 on the basis of a pressure signal from the pressure sensor 47.

Accordingly, when the turning operation of the rotating motor RM and the moving-down operation of the boom cylinder BC are simultaneously performed, the tilt angle of the assist motor AM may be determined with reference to the required moving-down speed of the boom cylinder BC irrespective of the turning pressure or the brake pressure.

At all events, the output of the assist motor AM can be used to assist the output of the sub-pump SP, and also the fluid flow discharged from the sub-pump SP can be divided at the first, second proportional solenoid throttling valves 40, 41 proportionally between the first, second circuit systems for delivery to the first, second circuit systems.

On the other hand, for use of the assist motor AM as a drive source and the electric motor MG as a generator, the tilt angle of the sub-pump SP is changed to zero such that the sub-pump SP is put under approximately no-load conditions, and the assist motor AM is maintained to produce an output required for rotating the electric motor MG. By doing so, the output of the assist motor AM can be used to allow the electric motor MG to fulfill the generator function.

In the embodiment, the output of the engine E can be used to allow the generator 22 to generate electric power or the assist motor AM can be used to allow the electric motor MG to generate electric power. Then, the electric power thus generated is accumulated in the battery 24. In this connection, in the embodiment, since the household power source 25 may be used to accumulate electric power in the battery 24, the electric power of the electric motor MG can be utilized for various components.

In the embodiment, on the other hand, the fluid from the rotating motor RM or the boom cylinder BC can be used to rotate the assist motor AM, and also the output of the assist motor AM can be used to assist the sub-pump SP and the electric motor MG. This makes it possible to minimize the energy loss produced until regenerated power is available. For example, fluid flowing from an actuator may be used to rotate a generator, and in turn the electric power accumulated by the generator may be used to drive an electric motor, and then the driving force of the electric motor may be used to actuate the actuator. As compared with this case, the regenerated power of the fluid pressure can be used directly.

Note that reference numerals 51, 52 in FIG. 1 denote check valves located downstream of the first, second proportional solenoid throttling valves 40, 41. The check valves 51, 52 permit the fluid to flow from the sub-pump SP to the first, second main pumps MP1, MP2 only.

Since the check valves 51, 52 are provided and the solenoid directional control valve 46 and the solenoid on/off valve 50 or the proportional solenoid valve 34 are provided as described above, for example, when a failure occurs in the system including the sub-pump SP and the assist motor AM, the system including the first, second main pumps MP1, MP2 can be detached from the system including the sub-pump SP and the assist motor AM. In particular, when the solenoid directional control valve 46, the proportional solenoid valve 34 and the solenoid on/off valve 50 are under normal conditions, each of them is kept in its normal position which is the closed position by a spring force of a spring as illustrated in FIG. 1, and also the proportional solenoid valve 34 are kept in their normal positions which are the full open position. For this reason, even if a failure occurs in the electric system, the system including the first, second main pumps MP1, MP2 can be detached from the system including the sub-pump SP and the assist motor AM as described above.

For actuating any actuator in the work mechanical system, the operated valve connected to the actuator may be operated. When the operated valve is operated, it is possible to determine a flow rate required by the first, second circuit system, in accordance with pilot pressure in the pilot flow passage 9, 19. For this reason, the controller C controls the first, second proportional solenoid throttling valves 40, 41 as described earlier, in order to divide the discharge flow of the sub-pump SP proportionally between the first, second circuit systems for delivery for delivery to the first, second circuit systems.

In addition, when any actuator in the work mechanical system is operated as described above, the electric motor MG rotates in a range of higher than the rated capacity. However, upon the actuation of the rotating motor RM or the boom cylinder BC, the controller C detects this actuation, thus making it possible to perform control of reducing the load on the electric motor MG by an amount corresponding to the assist force of the assist motor AM. Alternatively, instead of a reduction in the load on the electric motor MG, it is possible to increase the power of the electric motor MG by an amount corresponding to the assist force of the assist motor AM, to increase the output of the sub-pump SP.

REFERENCE SIGNS LIST

Figure 1:
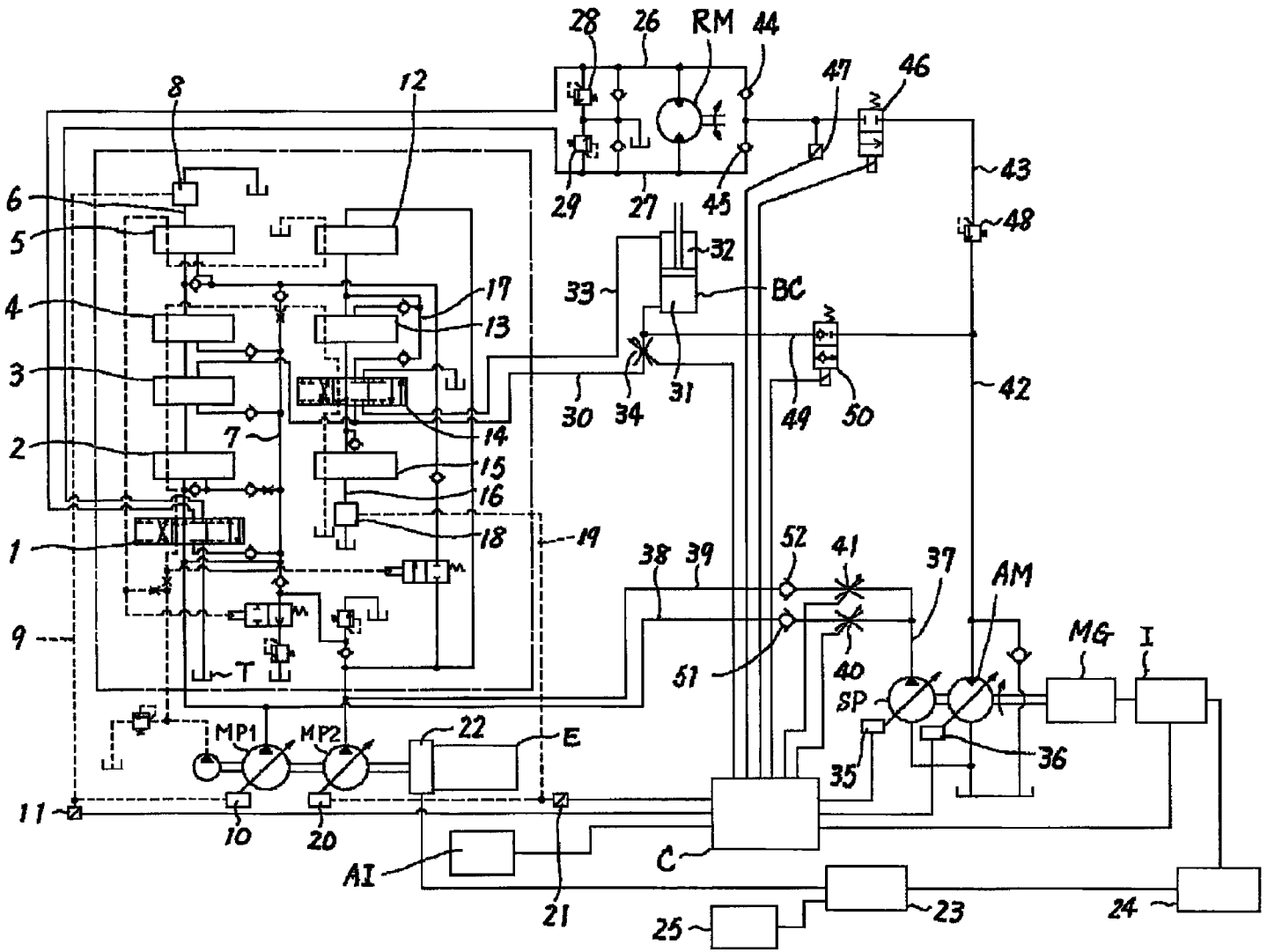
FIG. 1 is a circuit diagram illustrating an embodiment according to the present invention.
Figure 2:
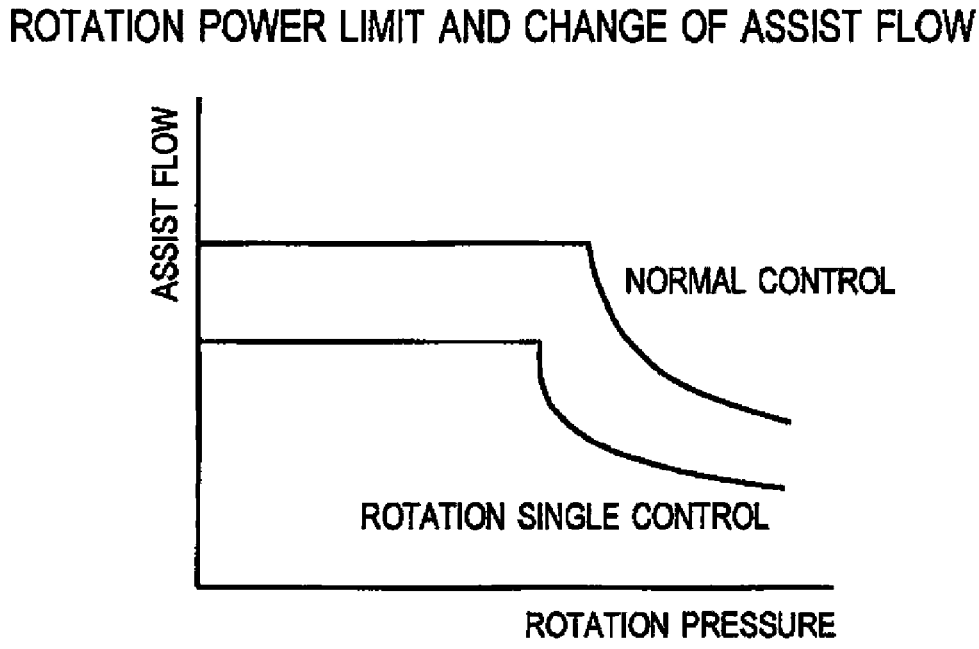
FIG. 2 is a graph showing assist characteristics of the sub-pump.
Figure 3:
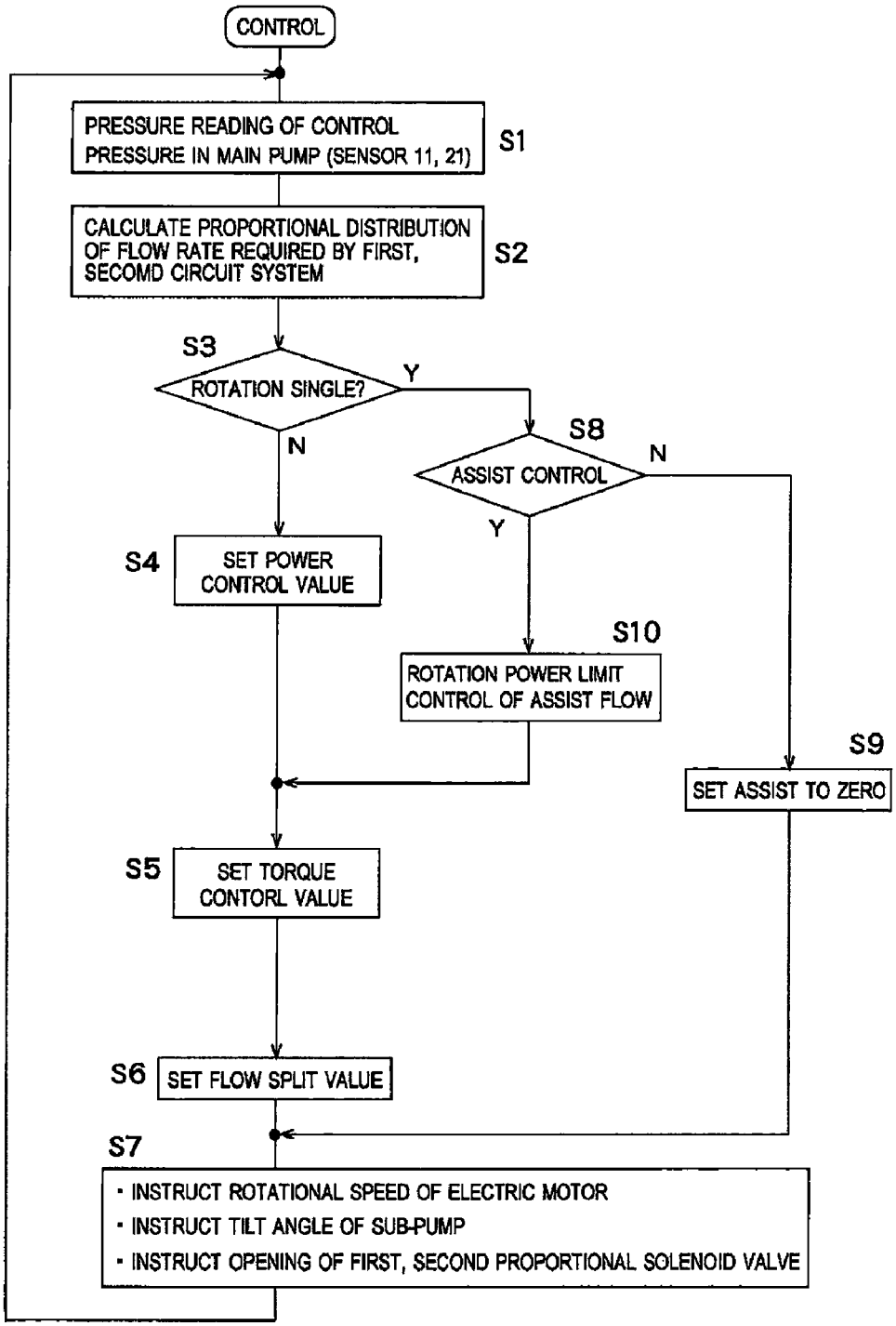
FIG. 3 is a flow chart illustrating a control system of the controller.

MP1 First main pump
MP2 Second main pump

RM Rotating motor
1 Rotating-motor operated valve
2 Arm-in-first-gear operated valve
3 Boom-in-second-gear operated valve
4 Auxiliary operated valve
5 First-travel-motor operated valve
C Controller
12 Second-travel-motor operated valve
13 Bucket operated valve
14 Boom-in-first-gear operated valve
15 Arm-in-second-gear operated valve
SP Sub-pump
35, 36 tilt-angle control unit
MG Electric motor (also serving as generator)
AI Assist setting input means

What is claimed is:

1. A control device for a hybrid construction machine, including a variable displacement type of a main pump, a circuit system connected to the main pump and including a plurality of operated valves for controlling actuators, and an operated valve for controlling a rotating motor provided in the circuit system, comprising:

a single operation detection unit that detects single operation of the rotating motor and outputs a signal representing a rotating motor single operation to the controller;

a variable displacement sub-pump;

a tilt angle control unit that controls a tilt angle of the sub-pump;

an electric motor that is a driving source of the sub-pump;

a merging passage connected to the sub-pump and communicating with a discharge side of the main pump;

an assist control input unit that inputs a signal representing whether or not assist control is required in the single operation of the rotating motor; and a controller that controls the tilt angle of the sub-pump and a rotational speed of the electric motor, wherein the controller comprises a function of controlling one of or both a rotational speed of the electric motor and a tilt angle of the sub-pump on the basis of a low output setting of the assist force which is lower than a low output set value in regular working operations, when the controller receives the signal representing a rotating-motor single operation from the single operation detection unit and receives the signal representing a need for an assist from the assist control input unit.

2. The control device for a hybrid construction machine according to claim 1, wherein the controller controls the output of the sub-pump on the basis of a high output setting of the assist force in regular working operations, and a low output setting of the assist force when controlling the single operation of the rotating motor and an assist is required.

3. The control device for a hybrid construction machine according to claim 1, wherein the controller comprises a function of setting output of the sub-pump to zero when an assist is not required in the single operation of the rotating motor.

4. The control device for a hybrid construction machine according to claim 2, wherein the controller comprises a function of setting output of the sub-pump to zero when an assist is not required in the single operation of the rotating motor.

* * * * *